US011717872B2

(12) United States Patent
Williamson et al.

(10) Patent No.: US 11,717,872 B2
(45) Date of Patent: Aug. 8, 2023

(54) STAMPING DEVICE FOR SHEET-METAL AMMUNITION TRAY

(71) Applicants: Seth Leland Williamson, King George, VA (US); Branden K. Hartman, Manassas, VA (US)

(72) Inventors: Seth Leland Williamson, King George, VA (US); Branden K. Hartman, Manassas, VA (US)

(73) Assignee: United States of America, as represented by the Secretary of the Navy, Arlington, VA (US)

( * ) Notice: Subject to any disclaimer, the term of this patent is extended or adjusted under 35 U.S.C. 154(b) by 0 days.

(21) Appl. No.: 17/064,868

(22) Filed: Oct. 7, 2020

(65) Prior Publication Data

US 2022/0105554 A1 Apr. 7, 2022

(51) Int. Cl.

| | |
|---|---|
| ***B21D 22/02*** | (2006.01) |
| ***B21D 53/00*** | (2006.01) |
| ***B21D 37/10*** | (2006.01) |

(52) U.S. Cl.

CPC ..... *B21D 22/02* (2013.01); *B21D 37/10* (2013.01); *B21D 53/00* (2013.01)

(58) Field of Classification Search

CPC ..... B65D 71/72; B65D 2571/00043; B21D 22/02; B21D 35/001; B21D 35/002; B21D 37/10; B21D 37/12

See application file for complete search history.

(56) References Cited

U.S. PATENT DOCUMENTS

| | | | | |
|---|---|---|---|---|
| 1,787,151 | A * | 12/1930 | Groehn | B21D 22/02 72/383 |
| 1,858,047 | A * | 5/1932 | Ireland | B21D 37/10 72/312 |
| 1,995,711 | A * | 3/1935 | Irmis | B21D 37/12 33/645 |
| 5,052,167 | A | 10/1991 | Scharch | 53/444 |
| 5,499,438 | A | 3/1996 | Schutz | 20/407.01 |
| 9,469,078 | B2 | 10/2016 | Aganovic et al. | |

(Continued)

FOREIGN PATENT DOCUMENTS

| | | | | |
|---|---|---|---|---|
| CN | 107497939 A * | 12/2017 | | B21D 37/10 |
| CN | 107671159 A * | 2/2018 | | B21D 22/02 |

(Continued)

*Primary Examiner* — Katrina M Stransky
*Assistant Examiner* — P Derek Pressley
(74) *Attorney, Agent, or Firm* — Gerhard W. Thielman

(57) ABSTRACT

A stamping apparatus is provided for producing an ammunition tray from metal sheet template with interleaving parallel cutouts in conjunction with a shop press. The apparatus includes upper and lower tray dies, upper and lower binders, and a pair of bolsters. Each die has opposite external and internal sides. The external side has a depression pocket. The internal side has a die impression to shape the template. Each binder has a cavity. The tray dies are disposed between the binders. The bolsters are disposed for engaging the shop press to apply compressive force. Each bolster correspondingly inserts through the cavity and into the depression pocket. The template is disposed between lower and upper internal sides of respective the dies. The shop press applies compression to the bolsters for stamping the template by the dies into the ammunition tray.

14 Claims, 14 Drawing Sheets

(56) References Cited

U.S. PATENT DOCUMENTS

| | | | | |
|---|---|---|---|---|
| 10,435,218 | B1 * | 10/2019 | Little | F42B 39/14 |
| 10,845,174 | B2 | 11/2020 | Little et al. | F42B 39/26 |
| 2009/0026157 | A1 * | 1/2009 | Gibert Guasch | B65D 71/70<br>211/74 |
| 2019/0041181 | A1 * | 2/2019 | Little | F42B 39/26 |

FOREIGN PATENT DOCUMENTS

| | | | | | |
|---|---|---|---|---|---|
| CN | 108213204 | A | * | 6/2018 | |
| CN | 108787901 | A | * | 11/2018 | B21D 37/04 |
| CN | 109332488 | A | * | 2/2019 | B21D 22/20 |
| CN | 109570364 | A | * | 4/2019 | B21D 37/12 |
| CN | 109622787 | A | * | 4/2019 | B21D 37/10 |
| CN | 110227763 | A | * | 9/2019 | |
| CN | 111299419 | A | * | 6/2020 | |

* cited by examiner

Section A-A

STAMPING DEVICE FOR SHEET-METAL AMMUNITION TRAY

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to production of metal ammunition packing trays. In particular, the invention provides an apparatus to press sheet metal into a stackable sheet metal tray for stowing bullet cartridges in an ammunition box.

Ordnance ammunition is conventionally packaged within trays composed of high density polyethylene (HDPE). Conventional HDPE cradle packaging can ignite from weapons impact, which can cause delayed cook-off reactions of damaged or undamaged rounds in the stowage container. This constitutes a serious hazard to the warfighter.

SUMMARY

Conventional ammunition dunnage trays yield disadvantages addressed by various exemplary embodiments of the present invention. Instead a dunnage tray for holding ammunition cartridges within an ammunition box container with stowage volume has been developed and referenced in parent applications. In particular, exemplary embodiments provide an apparatus to stamp the dunnage tray for holding ammunition cartridges from metal sheet template with interleaving parallel cutouts in conjunction with a shop press. The apparatus includes upper and lower tray dies, upper and lower binders, and a pair of bolsters.

In exemplary embodiments, each die has opposite external and internal sides. The external side has a depression pocket. The internal side has a die impression to shape the template. Each binder has a cavity. The tray dies are disposed between the binders. The bolsters are disposed for engaging the shop press to apply compressive force. Each bolster correspondingly inserts through the cavity and into the depression pocket. The template is disposed between lower and upper internal sides of the respective dies. The shop press applies compression to the bolsters for stamping the template by the dies into the ammunition tray.

In other exemplary embodiments, front and rear insert flanges disposed adjacent to the upper binder to secure the template from lateral motion. Additionally, exemplary embodiments provide that each binder includes an opposing pair of lateral extensions, a pair of first compression resistors connect each upper extension on the upper binder to respective each lower extension on the lower binder, each binder includes six second compression resistors along an outer side facing opposite corresponding the die, and the first and second compression resistors engaging the bench press to receive the compressive force together with the bolsters

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

Figure 1:
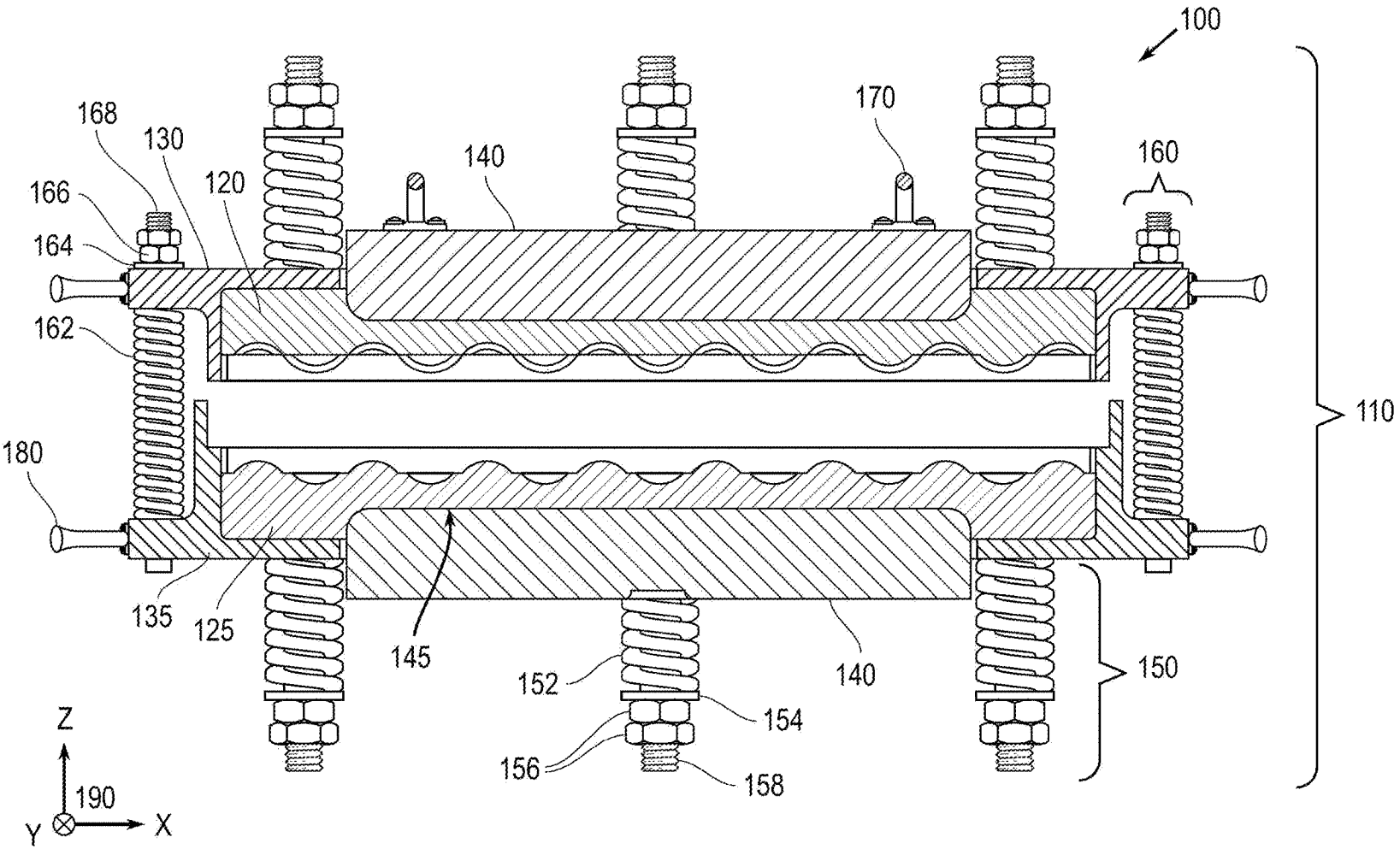
FIG. 1 is an elevation cross-sectional view of an exemplary stamping apparatus.

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

One of the objectives of the exemplary embodiments presented herein includes improvement of the Insensitive Munition and safety properties of ammunition packaging. The exemplary non-flammable dunnage tray mitigates this hazardous risk. The disclosure generally employs quantity units with the following abbreviations: length in inches (in), mass in pounds ($lb_m$) and so forth.

Recent testing of 25 mm (millimeter) caliber high explosive armor piercing ordnance for Insensitive Munitions (IM) evaluation revealed susceptibility of conventional HDPE packing trays used for decades by the United States armed services to catching fire in particular IM impact scenarios. Delayed cook-off reactions of remaining cartridge rounds caused by these burning trays were observed as long as forty-two minutes after the impact that initiated the reaction. This cook-off scenario poses a serious threat to personnel safety, as the cans containing burning trays do not necessarily emit large volumes of smoke and so can appear safe to approach from a distance.

Replacement of the tray material with something non-flammable, less flammable, or containing less potential chemical energy that satisfies other packaging requirements (cost, weight, vibrational, etc.) could eliminate this hazard. In this case, packaged units of ammunition have already reached their logistical weight limit, so any solution must weigh the same as or less than the conventional HDPE packing material.

For the purposes of this disclosure, a specific ammo can, the CNU-405/E packaged with unlinked 25 mm ammunition, is under examination, but the technology has broad applicability across any ammunition or ordnance packaged in trays of this type. Artisans of ordinary skill will recognize that the dimensions and stowage of unlinked ammunition described herein are exemplary and not limiting to other ordnance sizes.

Several materials were investigated that could serve as a replacement to HDPE. These included novel fire resistant or fire retardant plastics such as bishydroxydeoxybenzoin (BHDB), thermoplastics with lower potential energy such as polypropylene, reconstituted fiber-based products such as bagasse, well-characterized fire resistant meta-aramids such as Nomex™, and fireproof minerals such as vermiculite. Each of these was ultimately discarded due to such issues as insufficient Manufacturing Readiness Level, noxious off-gassing from combustion, poor workability and capacity to hold a constant shape, volumetric and weight requirements, vibrational requirements and humidity requirements. Ultimately, aluminum was selected as the candidate material with which to proceed.

FIG. 1 shows an elevation cross-sectional view 100 of an exemplary stamping apparatus 110 for stamping sheet metal into an ammunition tray for 25 mm bullets. The apparatus 110, shown in cross-section A-A, includes an upper die 120, a lower die 125, an upper binder 130, a lower binder 135 and a weighting pair of bolsters 140 that insert into corresponding depression mating pockets 145 of the dies 120 and 125.

The upper and lower binders 130 and 135 each share a half-dozen inner compression resistor assemblies 150. Each inner assembly 150 includes a helical die spring 152, a washer 154, a pair of thin hexagonal nuts 156 at the extremities of both binders 130 and 135. Further, a threaded setup stud 158 passes through each of the inner assemblies 150. The washer 154 restrains vertical movement of the spring 152, while the nuts 156 prevent dislodging the washer 154.

The apparatus 110 further includes a quad set of outer compression resistor assemblies 160. Each outer assembly 160 includes a helical die spring 162, a washer 164, a pair of thin hexagonal nuts 166 on a threaded setup stud 168. The washer 154 restrains vertical movement of the spring 152, while the nuts 156 prevent dislodging the washer 154. The upper bolster 140 includes a vertical pair of top handles 170. The binders 130 and 135 each have longitudinally flanking horizontal pairs of side handles 180. A compass rose 190 provides orientation with X (longitudinal), Y (lateral) and Z (vertical) directions for the assembly and separate components. The Y direction points aft, while the Z direction points upward.

Figure 2:
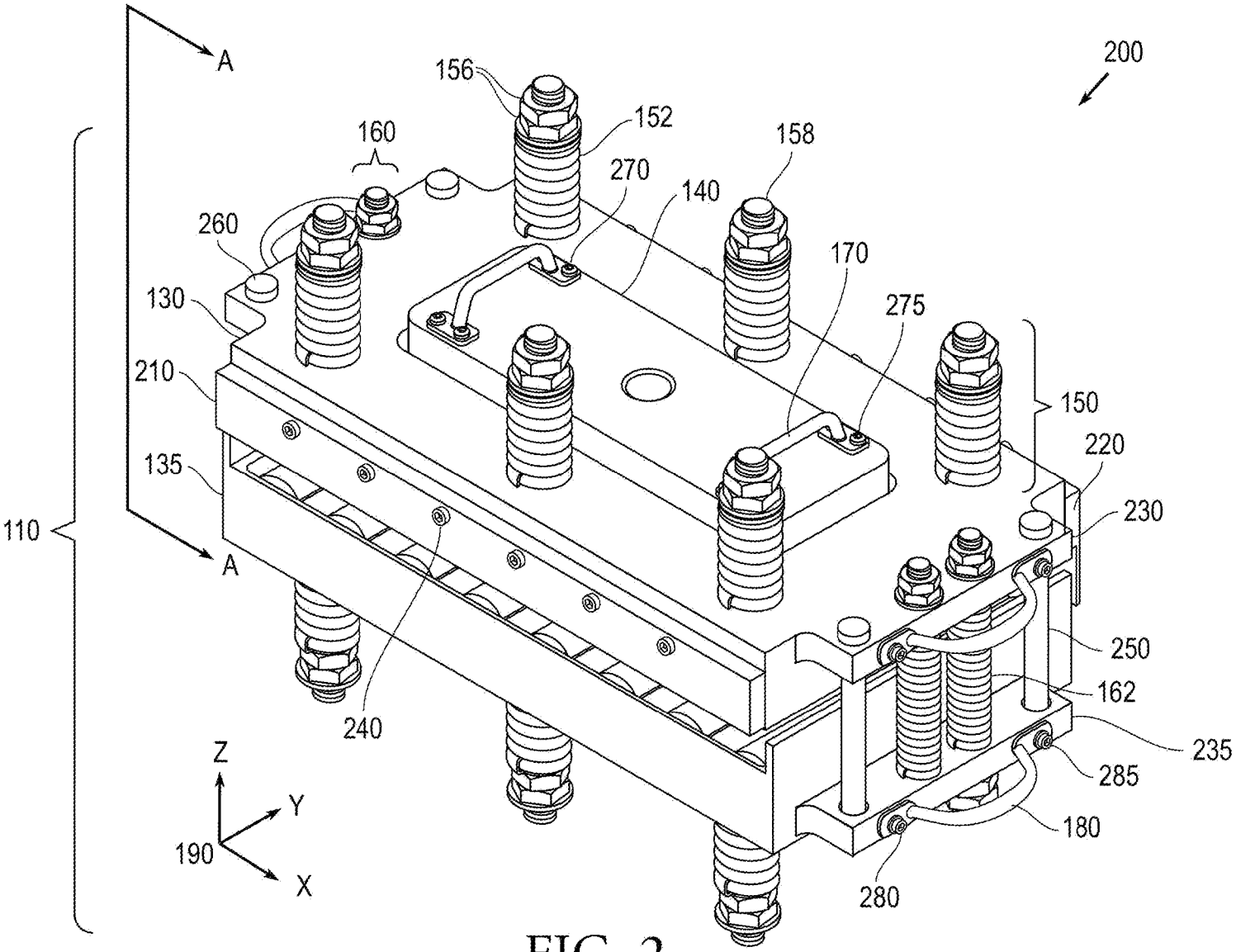
FIG. 2 is an isometric view of the exemplary stamping apparatus.

FIG. 2 shows an isometric assembly view 200 of the apparatus 110 with cross-section A-A parallel to the X-Z plane. Proximal front flanging insert 210 and distal rear flanging insert 220 attach to the upper binder 130, which includes flanges 230 that extend longitudinally. Similarly, the lower binder 135 includes flanges 235 that extend longitudinally. The inserts 210 and 220 attach to the upper binder 130 by socket head cap screws 240. The outer compression assemblies 160 connect the longitudinal flanges 230 and 235 together and are flanked by ejector pins 250 with flat tips 260 protruding from the binder 130. The top handles 170 attach to the (upper) bolster 140 on pads 270 secured by screws 275. The side handles 180 attach to the flanges 230 and 235 on pads 280 secured by screws 285.

The exemplary pressing operation using the exemplary stamping device 110 uses a conventional shop press (not shown). This shop press can be manual, hydraulic, benchtop configuration. The shop press includes a frame with vertical posts joined by an overhead bridge on which a piston-driven ram is mounted. A bed rests below the bridge to support the device 110 while being pressed by the ram.

The dies 120 and 125, binders 130 and 135, bolsters 140, and flanging inserts 210 and 220 are composed of grade-4340 steel. The helical springs 152 and 162 are composed of chrome silicon steel. The washers 154 and 164 are composed of zinc plated grade-8 steel. The hex nuts 156 and 166 are composed of zinc plated grade-5 steel. The studs 158 and 168 are composed of black oxide steel. The socket head cap screws 240 are composed of black oxide steel. The ejector pins 250 are composed of nitride coated H13 tool steel.

Figure 3:
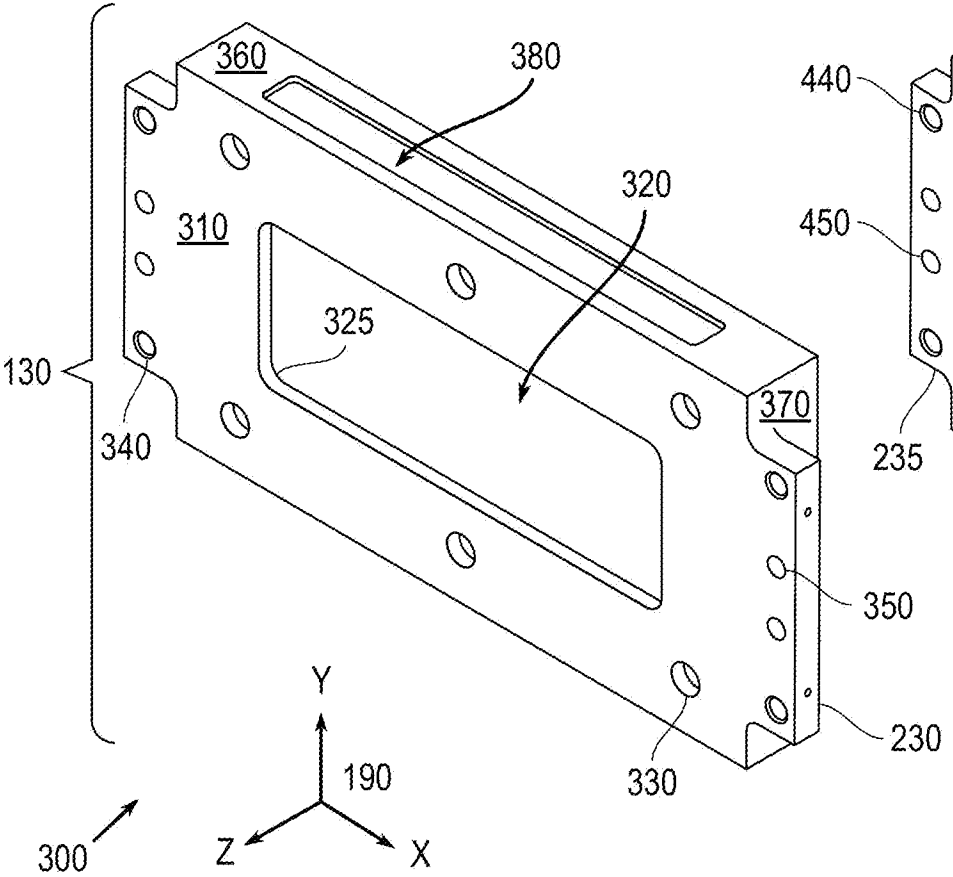
FIG. 3 is an isometric view of an upper binder.

FIG. 3 shows an isometric view 300 of the upper binder 130. To produce a tray for 25 mm ammunition, the dimensions are approximately: nineteen inches long with the flanges 230 included, nine-and-a-half inches wide and two inches high, weighing about twelve pounds (12 Ibm). The binder 130 has an upper planar face 310 having a vertically oriented rectangular cavity 320 with rounded corners 325 flanked by six planar through-holes 330. The cavity 320 is about twelve inches long and four inches wide to receive the bolster 140.

The flanges 230 include outward holes 340 and inward holes 350. The binder 130 also has longitudinal sides 360 and lateral sides 370 from which the flanges 230 protrude. The longitudinal sides 360 each include a horizontal rectangular slot 380. The six inner compression assemblies 150 pass through the planar holes 330. The ejector pins 250 pass through the outward holes 340. The four outer compression assemblies 160 pass through the inward holes 350.

Figure 4:
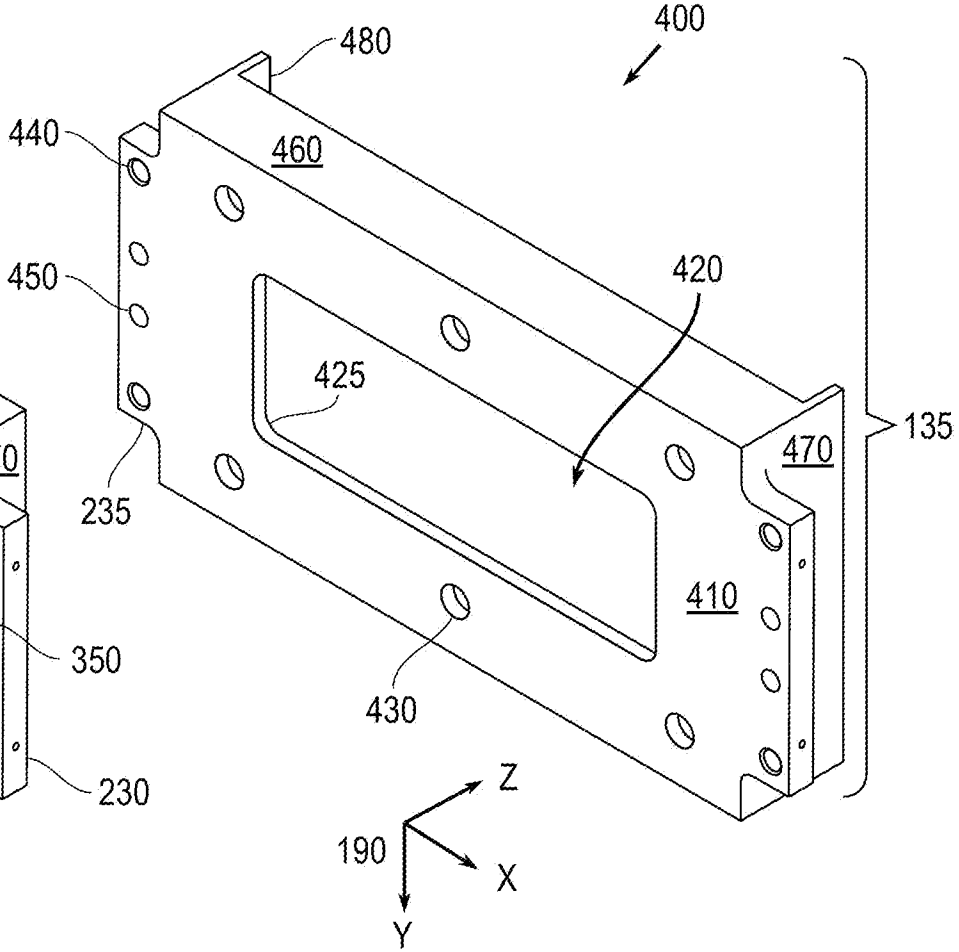
FIG. 4 is an isometric view of a lower binder.

FIG. 4 shows an isometric view 400 of the lower binder 135. For the exemplary tray, the dimensions are approximately: nineteen inches long with the flanges 235 included, nine-and-a-half inches wide and two inches high, weighing about twelve pounds (12 Ibm). The binder 135 has a lower planar face 410 having a vertically oriented rectangular cavity 420 with rounded corners 425 flanked by six planar through-holes 430. The cavity 420 is about twelve inches long and four inches wide to receive the bolster 140.

The flanges 235 include outer holes 440 and inner holes 450. The binder 135 also has longitudinal sides 460 and lateral sides 470 from which the flanges 235 protrude. Each lateral side 470 includes a vertical extension 480. The compression assemblies 150 pass through the planar holes 430. The ejector pins 250 pass through the outer holes 440. The compression assemblies 160 pass through the inner holes 450.

Figure 5:
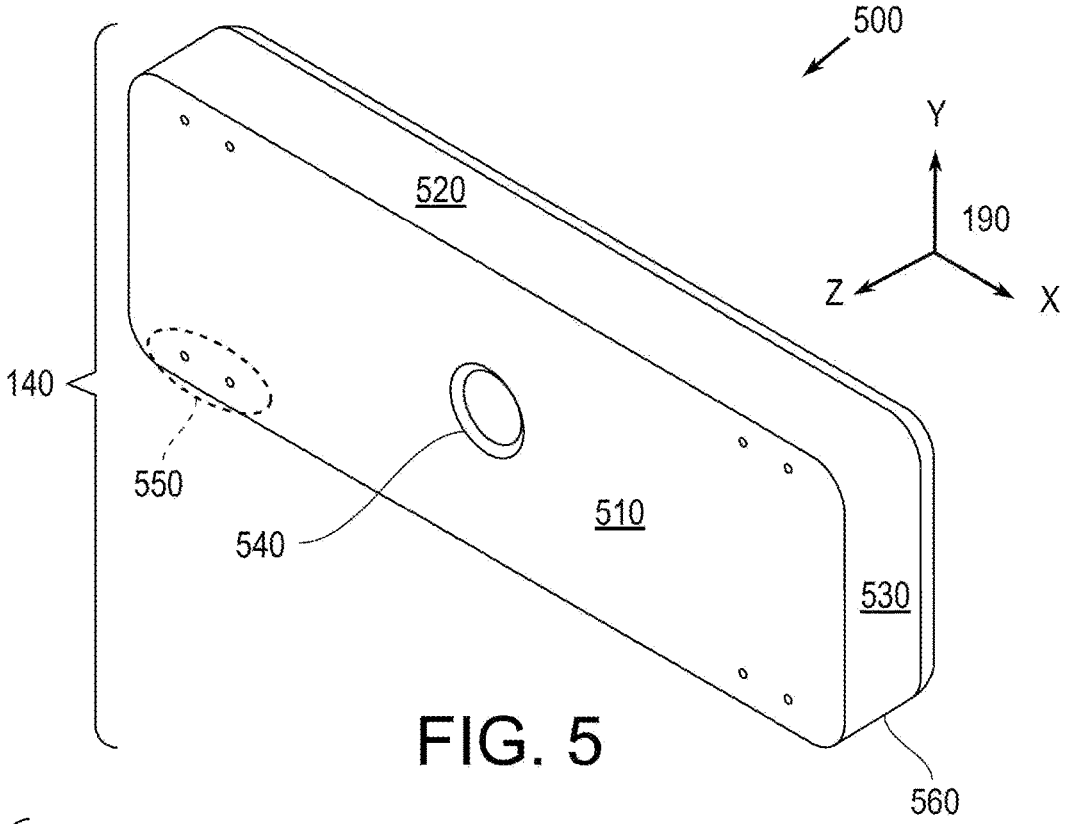
FIG. 5 is an isometric view of a bolster.

FIG. 5 shows an isometric view 500 of the bolster 140. For the exemplary tray, the dimensions are approximately twelve inches long, four inches wide and one-and-three-quarters inches thick, weighing about twenty-five pounds (25 $lb_m$) each. The bolster 140 has an outer flat planar face 510 opposite a rounded inner planar face (hidden) that inserts into the pocket 145 of one of the dies 120 and 125 after passing through the cavity 320 of the upper binder 130 or the cavity 420 of the lower binder 135.

The planar faces connect by longitudinal sides 520 and lateral sides 530. A chamfered circular depression 540 about one inch in diameter is disposed in the center of the face 510 to serve as a centering feature for the ram of the shop press.

Near the corners of the face 510 are a pair of holes 550 through which the screws 275 can be inserted for securing the upper handle 170. Sides 520 and 530 join at rounded edges 560.

Figure 6:
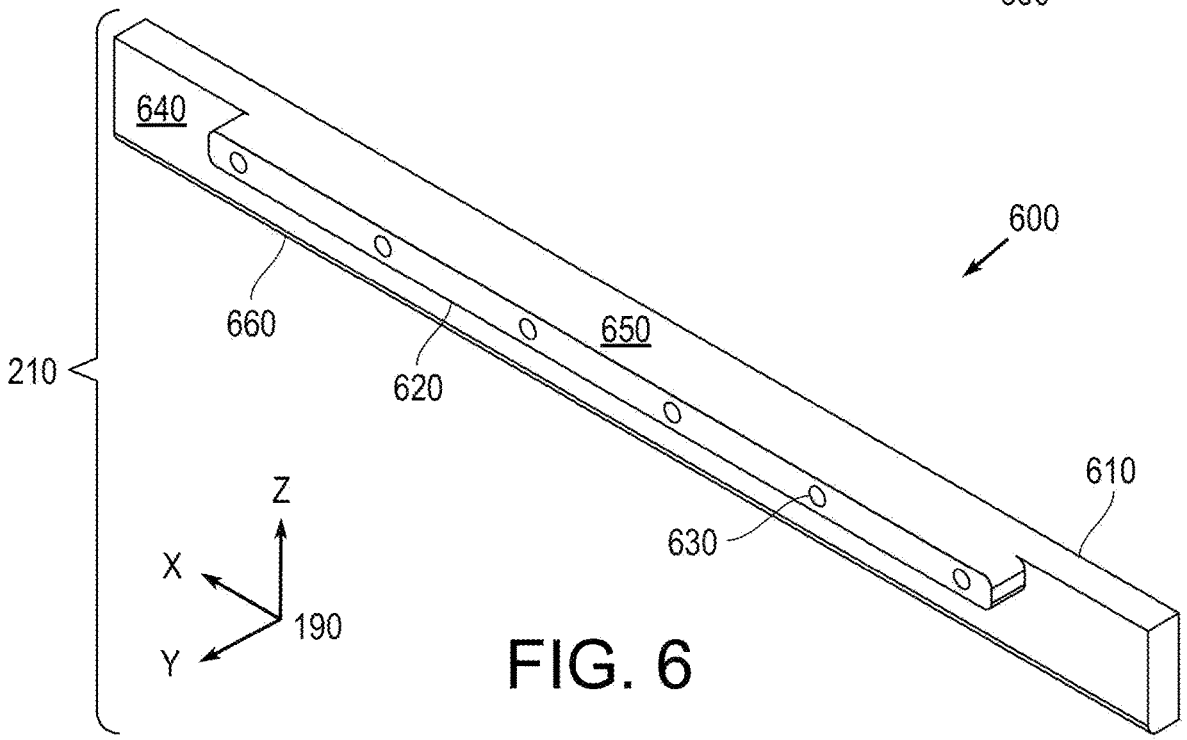
FIG. 6 is an isometric view of a front insert.

FIG. 6 shows an isometric view 600 of the front flanging insert 210. For the exemplary tray, the dimensions are approximately seventeen inches long and one-and-a-half inches tall. The insert 210 comprises a rectangular plate 610 and a lateral protrusion 620 that inserts into the slot 380. A series of through holes 630 extend through the plate 610 and protrusion 620 for the socket head cap screws 240 to connect the insert 210 to the binder 130. The plate 610 has an inner face 640 that abuts the binder 130. The plate 610 and protrusion 620 share an upper face 650. The plate 610 also includes a rounded edge 660.

Figure 7:
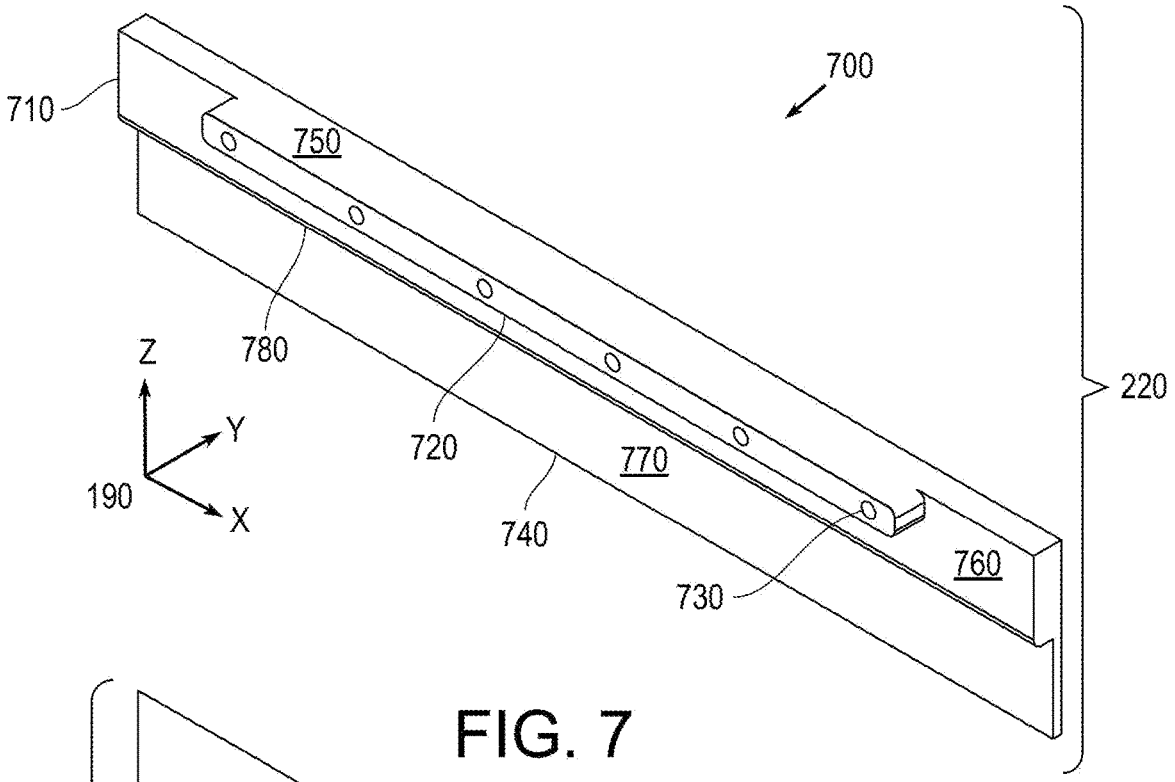
FIG. 7 is an isometric view of a rear insert.

FIG. 7 shows an isometric view 700 of the rear flanging insert 220. For the exemplary tray, the dimensions are approximately seventeen inches long and about three inches tall. The insert 220 comprises a rectangular plate 710 and a lateral protrusion 720 that inserts into the slot 380. A series of through holes 730 extend through the plate 710 and protrusion 720 for the socket head cap screws 240 to connect the insert 220 to the binder 130. The plate 710 includes a wall 740 that extends vertically downward. The plate 710 and protrusion 720 share an upper face 750. The plate 710 and wall 740 have respective inner faces 760 and 770 that abut the binder 130. The plate 710 also includes a rounded edge 780.

Figure 8A:
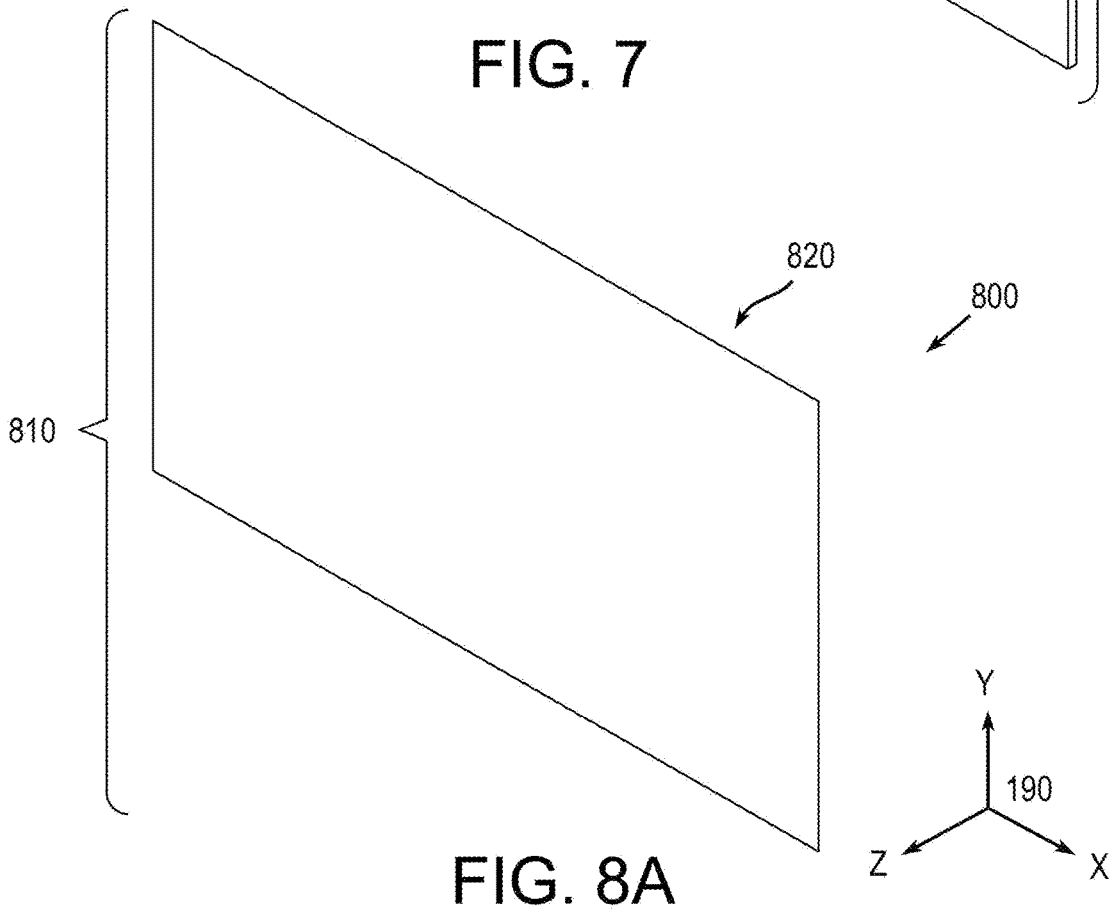
FIGS. 8A and 8B are isometric views of blank and template metal sheets from which to form an exemplary ammunition tray.
Figure 8B:
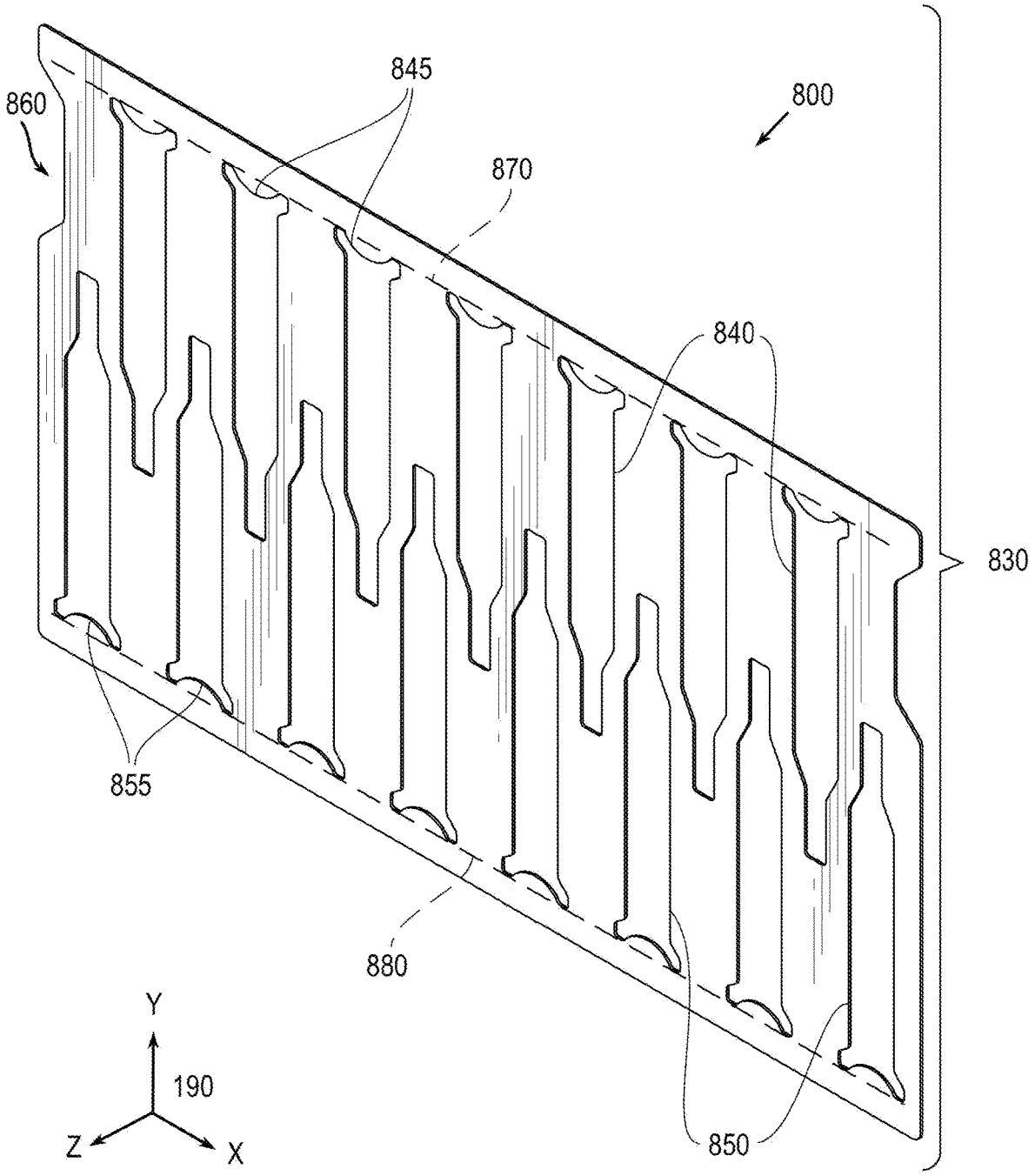

FIGS. 8A and 8B show isometric views 800 of blank and cut metal sheets that the assembly 110 deforms to form an ammunition tray composed of aluminum 5052-H32. FIG. 8A shows a template sheet blank 810 with four rounded corners 820. The blank 810 is about seventeen inches long and about ten inches wide with a stock thickness of 0.025 inch. Prior to stamping between the dies 130 and 135, the blank 810 is subject to a punching operation to produce a tray template 830.

FIG. 8B shows the template 830 with a fore row of seven cutouts 840 with corresponding base arcs 845 and an aft row of eight cutouts 850 with their base arcs 855. The cutouts 840 and 850 each have a beer-bottle-silhouette arranged in parallel with the narrow neck portion oriented inward on the template 830. (A beer-bottle silhouette constitutes a longitudinally joined pair of rectangular segments having distinguishable widths.) Lateral edge cutouts 860 are also shown to enable an operator's fingers to grasp the finished tray. A rear fold line 870 identifies the bending edge for the aft tab of the tray. A fore fold line 880 identifies the bending edge for the front tab of the tray.

Figure 9:
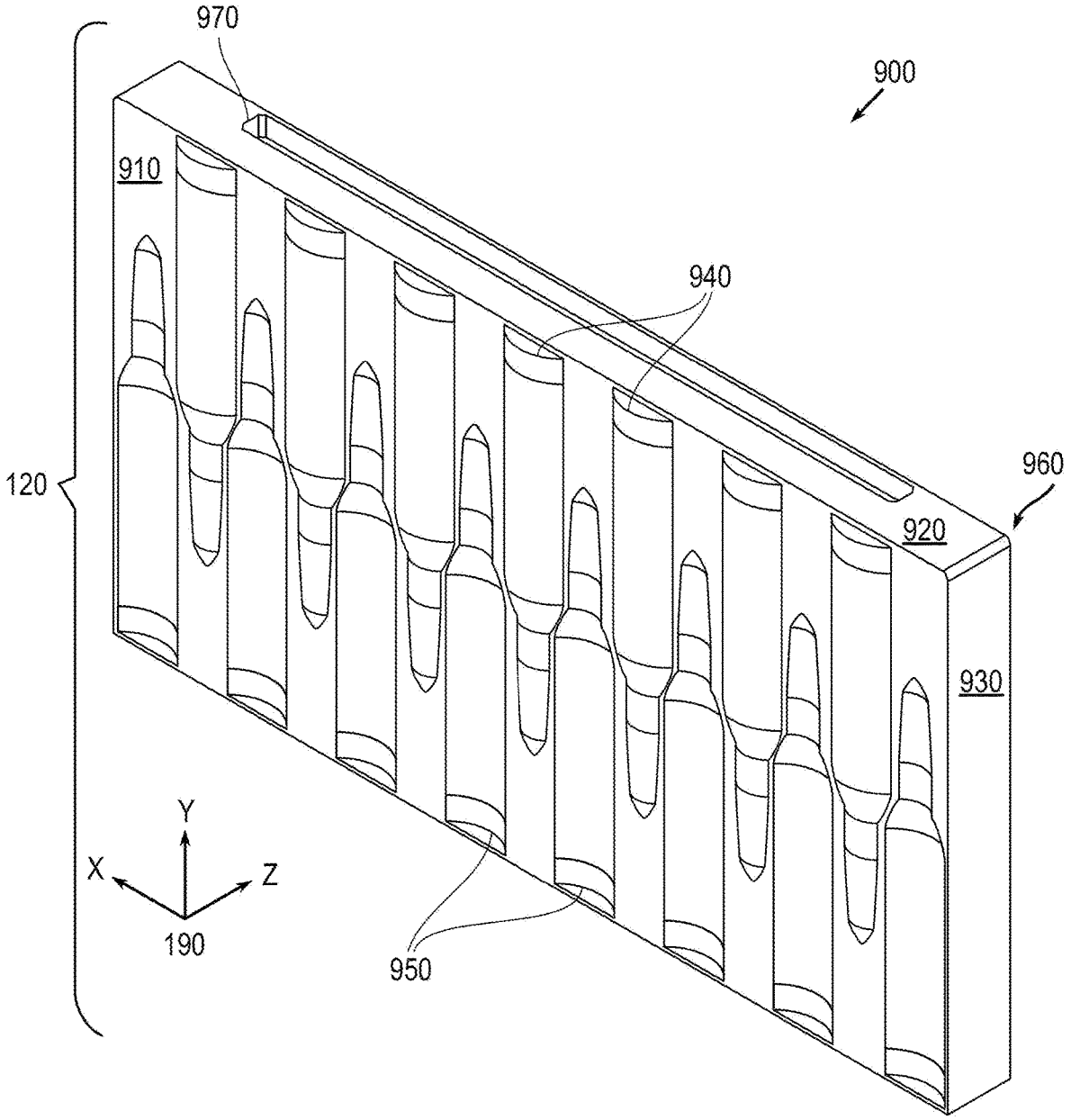
FIG. 9 is an isometric view of an upper die.

FIG. 9 shows an isometric assembly view 900 of the upper die 120. For the exemplary 25 mm ammo tray, the dimensions are approximately sixteen-and-a-half inches long, nine-and-a-third inches wide, and one-and-a-quarter inches tall. The die 120 includes an internal planar side 910 with an impression face that engages the template 830, with longitudinal sides 920 and lateral sides 930. The planar side 910 includes a fore row of seven rounded protrusions or rounded hills 940 and an aft row of eight rounded depressions or rounded valleys 950 interleaving each other in parallel with adjacent longitudinal separation of about one inch. The protrusions 940 and 950 correspond to and align with the respective cutouts 870 protrusions 845 and 850.

The sides 920 and 930 join at rounded edges 960. Each proximal and distal face for the longitudinal sides 920 of the upper die 120 includes a horizontal slot 970. The lateral protrusion 620 of the rear flanging insert 220 engages the slot 970 of the proximal face (shown). The lateral protrusion 720 of the front flanging insert 210 engages the slot 970 of the distal face (hidden). These inner slots 970 align with corresponding outer slots 380 of the upper binder 130. The bolster 140 inserts into the pocket 145 on an external side opposite the planar side 910 after passing through the cavity 320 of the upper binder 130.

Figure 10:
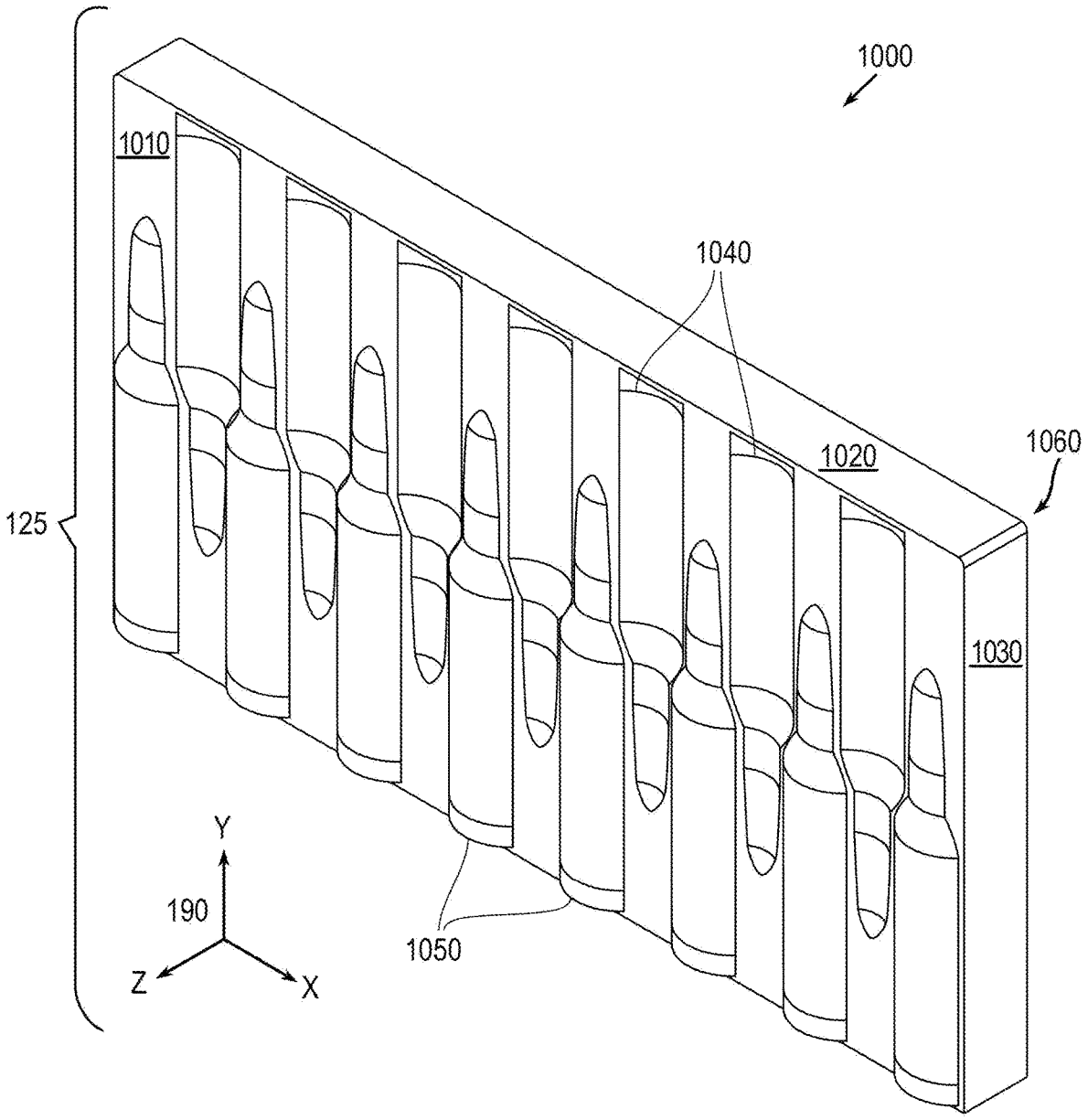
FIG. 10 is an isometric view of a lower die.

FIG. 10 shows an isometric assembly view 1000 of the lower die 125. For the exemplary tray, the dimensions are approximately sixteen-and-a-half inches long and nine-and-a-third inches wide. The lower die 125 includes a planar face 1010 with an impression face that engages the template 830, with longitudinal sides 1020 and lateral sides 1030. The planar side 1010 includes a fore row of seven rounded depressions 1040 and an aft row of eight rounded protrusions 1050. The depressions 1040 and protrusions 1050 interleave each other and correspond to the respective cutouts 870 and 880 to indent the template 830. The sides 1020 and 1030 join at rounded edges 1060. The bolster 140 inserts into the pocket 145 on an external side opposite the planar side 1010 after passing through the cavity 420 of the lower binder 135.

Figure 11A:
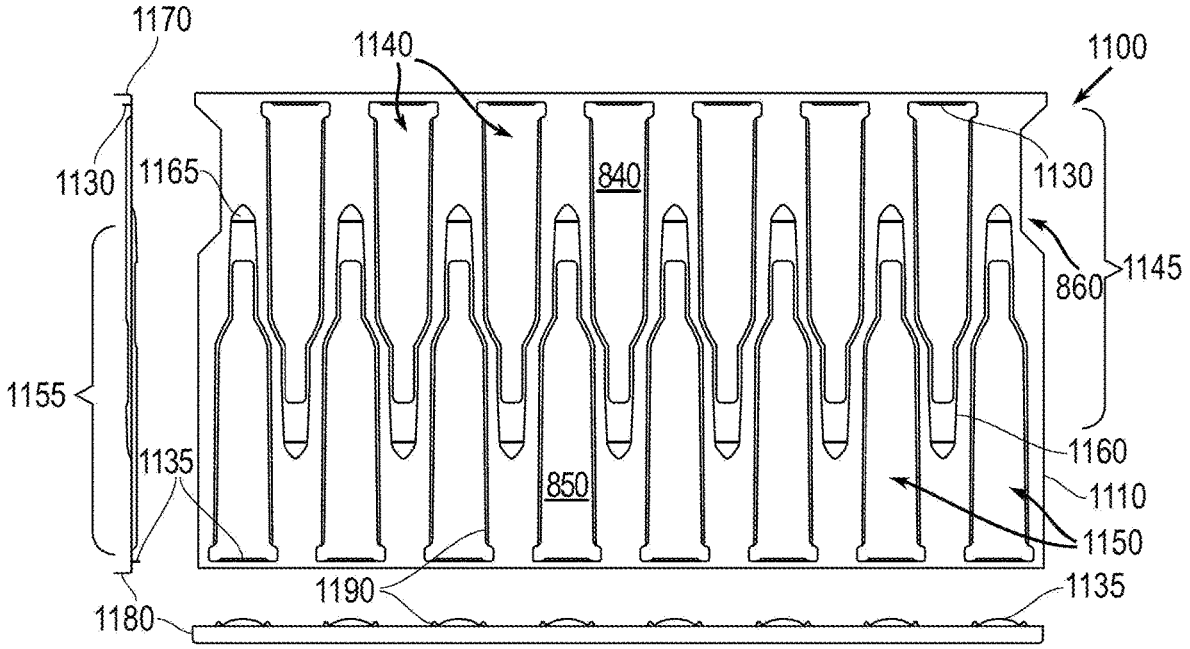
FIG. 11A is a set of planar and elevation views of the tray.
Figure 11B:
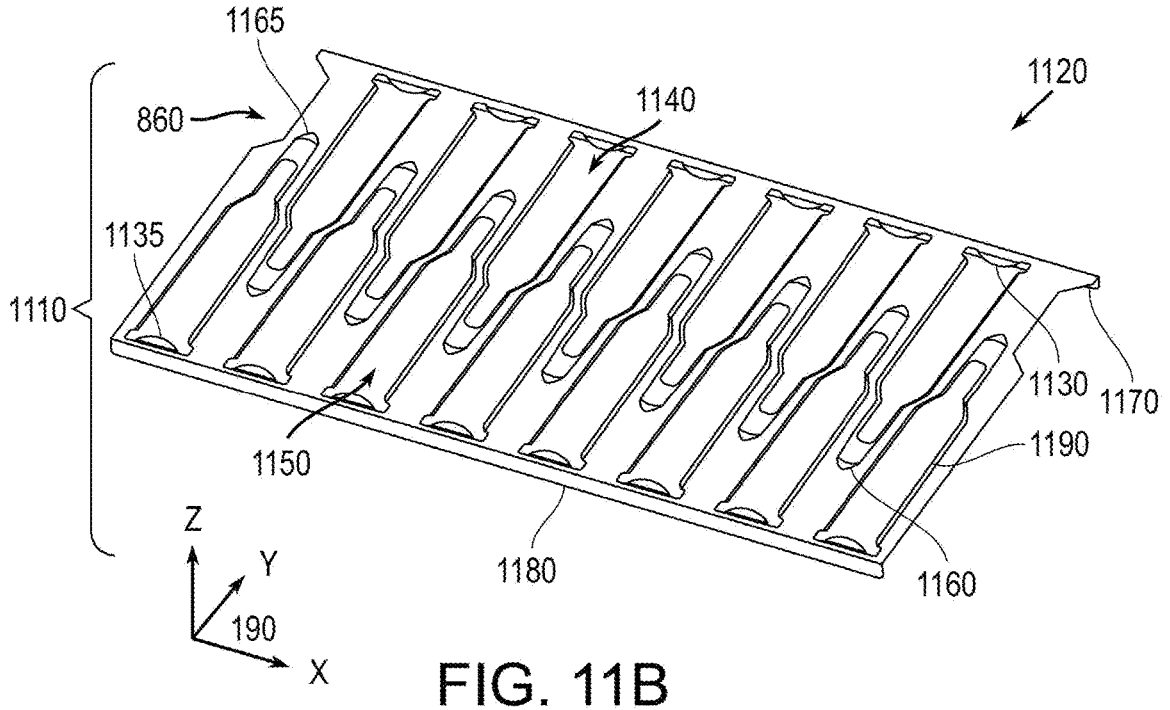
FIG. 11B is an isometric view of the ammunition tray.

FIG. 11A shows plan and elevation views 1100 of a completed ammunition tray 1110 that results from the dies 120 and 125 stamping against the template 830 via the apparatus 110. FIG. 11B show an isometric view 1120 of the tray 1110. Along its longitudinal edges, the tray 1110 includes aft arc tabs 1130 and fore arc tabs 1135 respectively disposed along seven cradles 1140 that form an aft row 1145, and eight cradles 1150 that form a fore row 1155.

Folding the aft base arcs 845 and the fore base arcs 855 yields the respective tabs 1130 and 1135. The cradles 1140 and 1150 constitute interleaving indented positions formed from respective cutouts 840 and 850. An aft rib 1170 bends downward from the longitudinal edge along the rear fold line 870, and a front rib 1180 also bends downward from the longitudinal edge along front fold line 880 in relation to the compass rose 190. These ribs 1170 and 1180 serve to stiffen the tray 1110.

Aft indentations 1160 inwardly extend from the cutouts 840 (extending from the necks of their bottle-silhouettes) to seat corresponding ogive tips of their respective ammo rounds. Similarly, fore indentations 1165 inwardly extend from the cutouts 850. The arc tabs 1130 and indentations 1160 in the aft cradles 1140 can thereby seat seven ammo rounds. The arc tabs 1135 and indentations 1165 in the fore cradles 1150 can thereby seat eight ammo rounds. Edge lips 1190 further reinforce the cradles 1140 and 1150 to restrict lateral sliding of their seated ammo rounds.

Figure 12A:
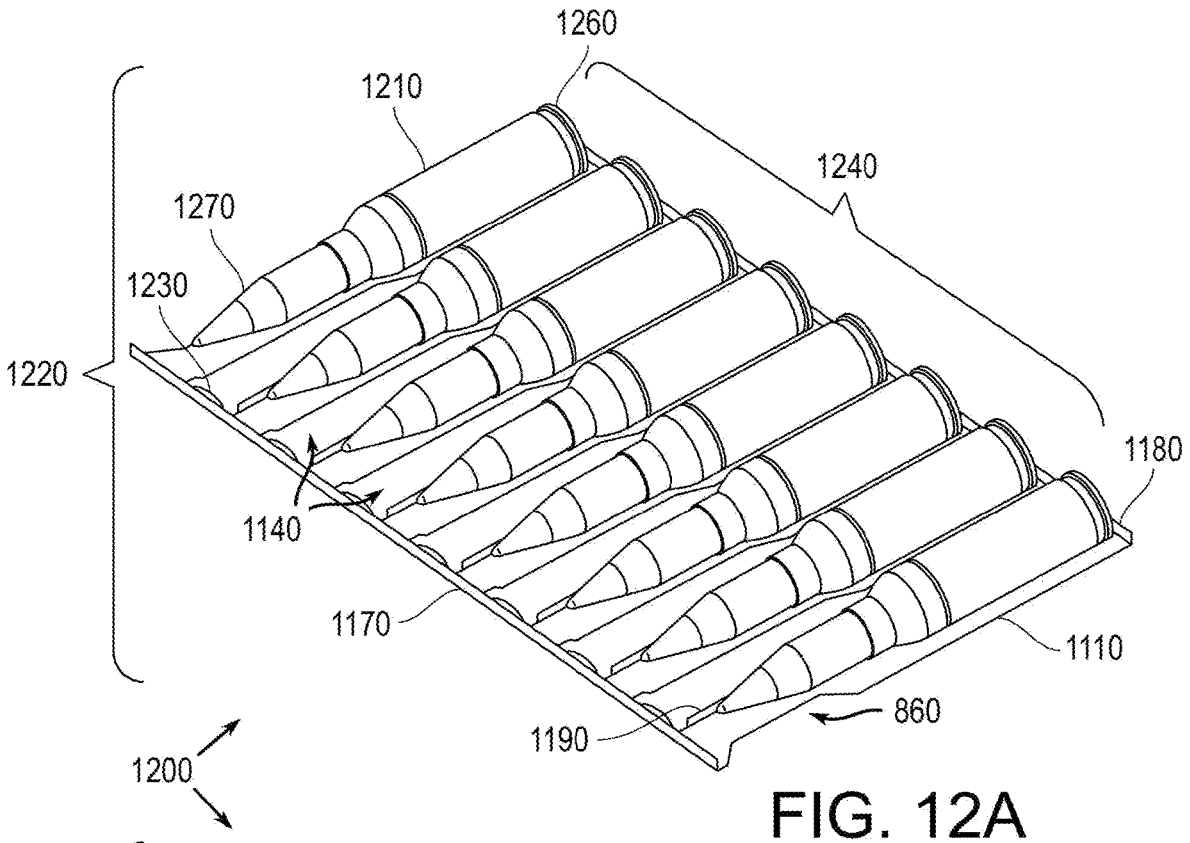
FIGS. 12A and 12B are isometric views of loaded ammunition trays.
Figure 12B:
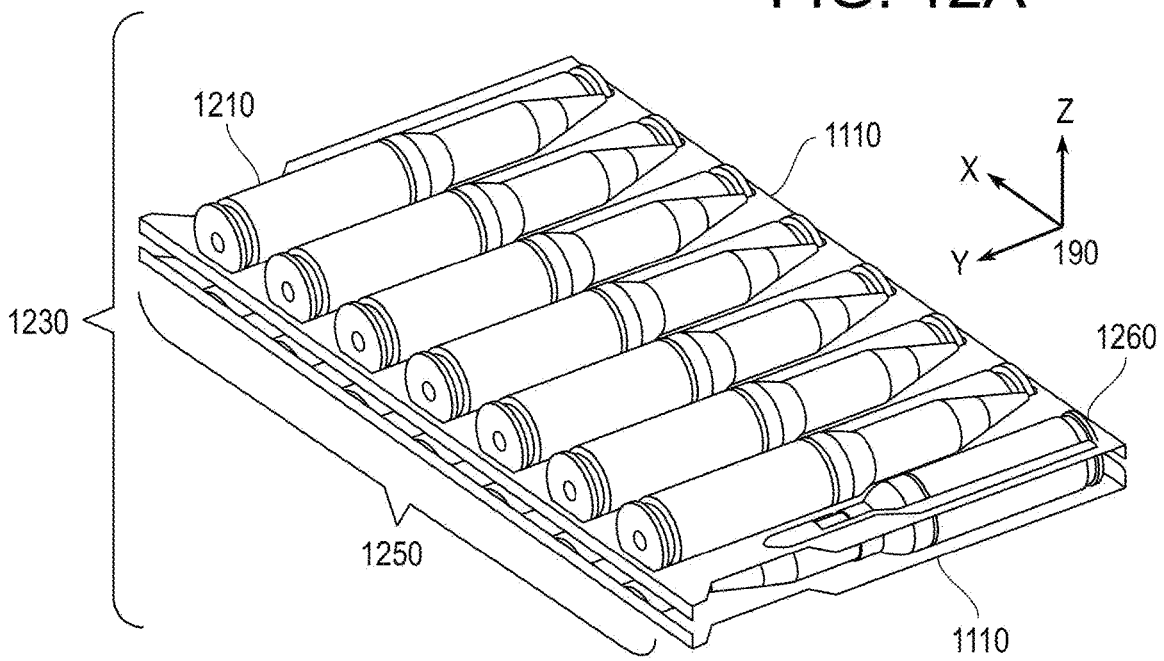

FIGS. 12A and 12B show isometric views 1200 of ammunition trays 1110 to hold ammunition rounds 1210. FIG. 12A features a single tray 1110 positioned up-side-down 1220, while FIG. 12B features a pair 1230 of stacked trays 1110 with the upper unit above the up-side-down lower unit. This can be observed by orientation of the ribs 1170 and 1180 facing each other upward from the lower tray 1110 and downward from the upper tray 1110.

A lower row 1240 of rounds 1210 points aft (e.g., towards the rear flanging insert 220 upon removal of the tray 1110 from the device 110). An upper row 1250 of rounds 1210 points forward (e.g., similarly towards the front flanging insert 210). The arc tabs 1130 and 1135 both block outward spilling from the bases 1260 of the rounds 1210, while the indentations 1160 and 1165 inhibit motion from the ogive tips 1270 of these rounds 1210.

The cradles 1140 and 1150 hold ammo rounds 1210 in position and inhibit migration from vertically adjacent trays. The bases 1260 of the rounds 1210 are disposed along the longitudinal edges of the tray 1110 adjacent the folds 1170 and 1180, while ogive tips 1270 point inward. When stacked, these trays 1110 can be vertically inserted into a CNU-405/E ammunition can. An analogous tray developed for these purposes together with the ammo container are described in U.S. Pat. 10,845,174.

The exemplary tray stamping device 110 comprises two halves, an upper die assembly and a lower die assembly. The upper die assembly includes the upper die 120, which is held in close contact against an upper binder 130 through the six inner compression assemblies 150. The setup stud 158 of each of these inner compression assemblies 150 threads into the upper die 120. The upper binder 130 is then disposed over these six studs 158. A helical die spring 152 is disposed around each stud 158 and vertically secured by washer 154 and two hex nuts 156 on their corresponding studs 158. To prevent movement or loosening during operation of the stamping dies 120 and 125, the hex nuts 156 are preloaded against one another in a "jam nut" configuration.

The protrusions 620 and 720 of their respective flanging inserts 210 and 220 are then inserted into respective slots 380 of the upper binder 130 and then corresponding slots 970 of upper die 120 and secured in position with six socket head cap screws 240 per flanging insert. A lower die assembly comprises the lower die 125, the lower binder 135 and six inner compression assemblies 150 combined in a similar fashion as the upper die assembly. The lower die assembly incorporates no flanging insert, as corresponding slots are absent. Side handles 180 adorn the protrusions 230 and 235 of the respective upper and lower binders 130 and 135. These side handles 180 serve as assembly aids to enable manual gripping of the binders 130 and 135.

The exemplary stamping device 110 is almost entirely steel, resulting in a total assembly weight of 213 $lb_m$. The approximately 75 $lb_m$ for the upper and lower die assemblies individually weigh about 75 $lb_m$. As both bolsters 140 are steel, each one weighs approximately 25 $lb_m$. When assembled together as a unit, the upper and lower die assemblies are oriented such that the upper die 120 and lower die 125 face opposite one another.

The upper and lower die assemblies interface with one another through a quad set of outer compression assemblies 160 with die springs 162 and a quad set of ejector pins 250. The quad set of outer compression assemblies 160 is erected in a similar fashion as the previously detailed inner assemblies 150. The purpose of the quad set of die springs 162 is to hold the dies 120 and 125 apart prior to a stamping operation for insertion of the template 830 and again after a stamping operation for removal of the finished tray 1110.

The ejector pins 250 are precision ground stock items that enable precision alignment between the two dies 120 and 125 to prevent their interference or misalignment during stamping operation. The final parts of the stamping die device 110 are the bolsters 140. A bolster 140 sits in a mating pocket 145 on the rear face of each upper die 120 and lower die 125 opposite their respective planar faces 910 and 1010.

The bolsters 140 serve as interfaces between the bed and the ram of the shop press. These bolsters 140 act as stiff rigid structures that evenly distribute the concentrated loads from the press bed (or apron plate) and ram across the upper die 120 and lower die 125 to prevent their warping or distortion during the stamping operation.

Top handles 170 secure to the upper bolster 140 with screws 275 to aid in assembly of the device 110. Additionally, the bolsters 140 do not physically attach to the upper and lower die assemblies. This reduces the combined weight that an operator has to move around during assembly. The assembly process for the exemplary stamping dies 120 and 125 includes disposing a bolster 140 on the bed of the shop press, then disposing the lower die assembly upon the lower bolster 140. The upper die assembly can then attach to the lower die assembly via the quad packs of outer assemblies 160 and ejector pins 250. An upper bolster 140 can then be disposed into the chamfered depression 540 atop the upper die 120 in the upper die assembly.

To produce a tray template 830, a sheet blank 810 is prepared with appropriate cutouts 840, 850 and 860. To operate the exemplary stamping device, the template 830 is inserted between the two dies 120 and 125, which rest on the edges of the lower binder 135. The wall 740 of rear flanging insert 220 and interior walls 480 of lower binder 135 enable proper alignment of the template 830 in the device 110.

The stamping operation then initiates with the ram of the bench press exerting force in the centering indentation 540 of the upper bolster 140. This force compresses the quad set of weaker compression springs 162, binding the template 830 between the outer edges of the upper and lower binders 130 and 135.

As the bench press applies additional force, the quad set of outer die springs 162 can no longer compress, so the stiffer and stronger hex sets of inner die springs 152 begin to simultaneously compress. The load for the press transfers through the bolsters 140 to the upper and lower dies 120 and 125, which advance simultaneously toward the restrained template 830 suspended between them.

As the upper die 120 advances toward the template 830, so also do the front and rear flanging inserts 210 and 220 that affix to the upper die 120 via the slots 970 receiving their respective protrusions 620 and 720. The dies 120 and 125 concurrently advance and stamp the template 830 from two opposing directions to form indentations 1160 and 1165 onto which ogive tips 1270 of the ammo rounds 1210 lay.

The dies 120 and 125 also bend the tabs 1130 and 1135 against which the bases 1260 of the ammo rounds 1210 rest against. Concurrently, the flanging inserts 210 and 220 bend the template 830 at a right angle downward (sandwiched by the lower die 125) at the front and rear fold lines 870 and 880 to form respective stiffening tabs 1170 and 1180 on the template 830.

Once the dies 120 and 125 have advanced fully, stamping of the tray 1110 is complete. Upon releasing the ram load from the bench press, the upper and lower hex sets of compression springs 152 unload, separating the two dies 120 and 125 from the tray 1110 and the quad set of springs 162 decompresses, separating the upper and lower die assemblies, thereby enabling the operator to remove the stamped ammunition tray 1110, which is now ready for use.

This exemplary apparatus 110 provides both mechanism and technique to fabricate trays 1110 for improving munition/ordnance safety while deployed aboard ship and during transport and storage. The exemplary trays 1110 do not combust as do conventional HDPE trays, thereby improving safety. Being composed of sheet aluminum and utilizing folded edges, the configuration for the exemplary trays 1110 is stiffer, stronger and more reusable than the conventional tray arrangement as well at nearly the same mass. By comparison, the weights of the conventional and exemplary trays are 155 grams and 170 grams for 25 mm ammunition. Additionally, the stiffness reduces risk spilling of rounds 1210 compared to HDPE trays that bow substantially in the center when fully loaded with rounds 1210.

Figure 13A:
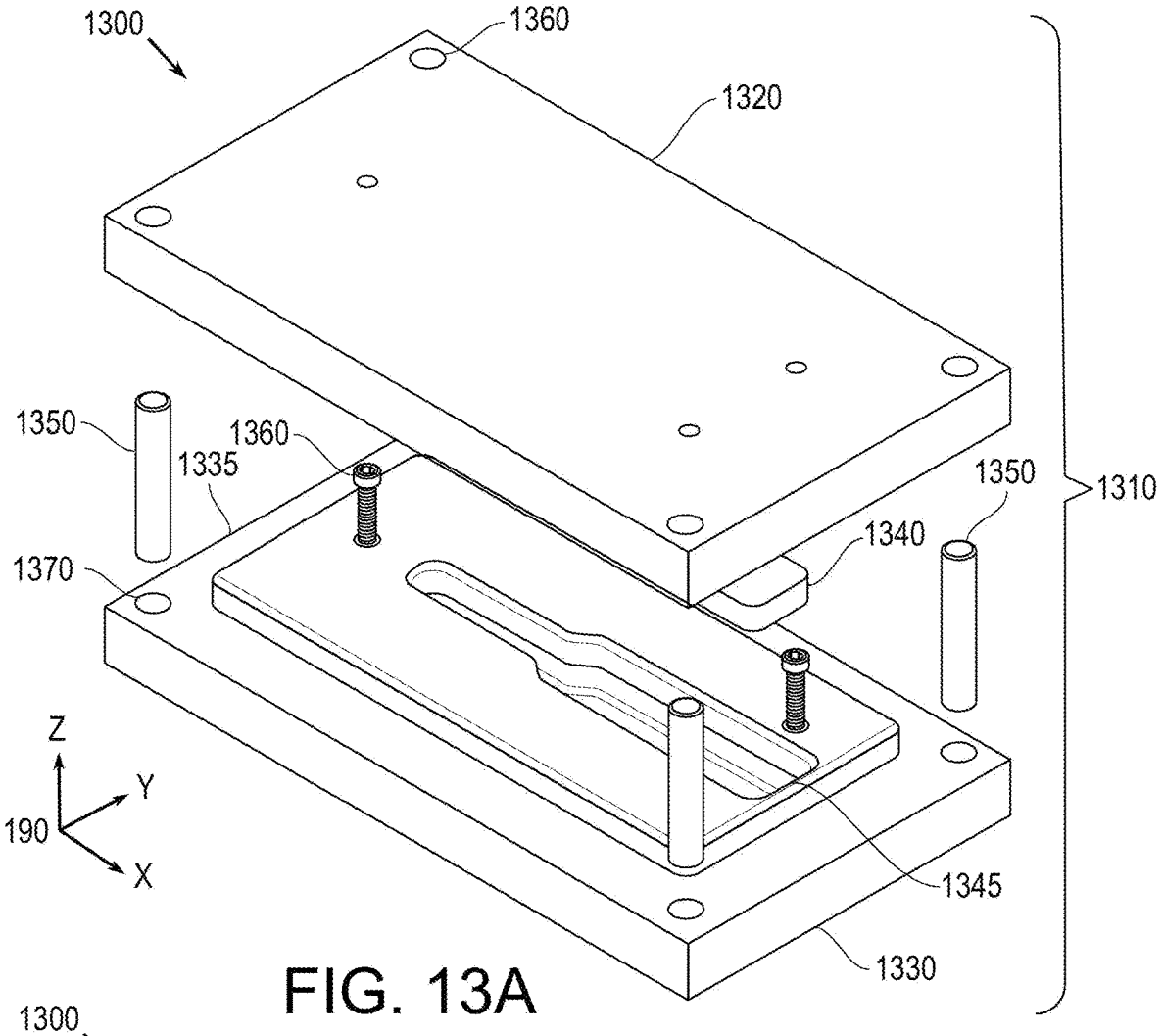
FIGS. 13A and 13B are isometric and elevation exploded views of components for a single-round test die.
Figure 13B:
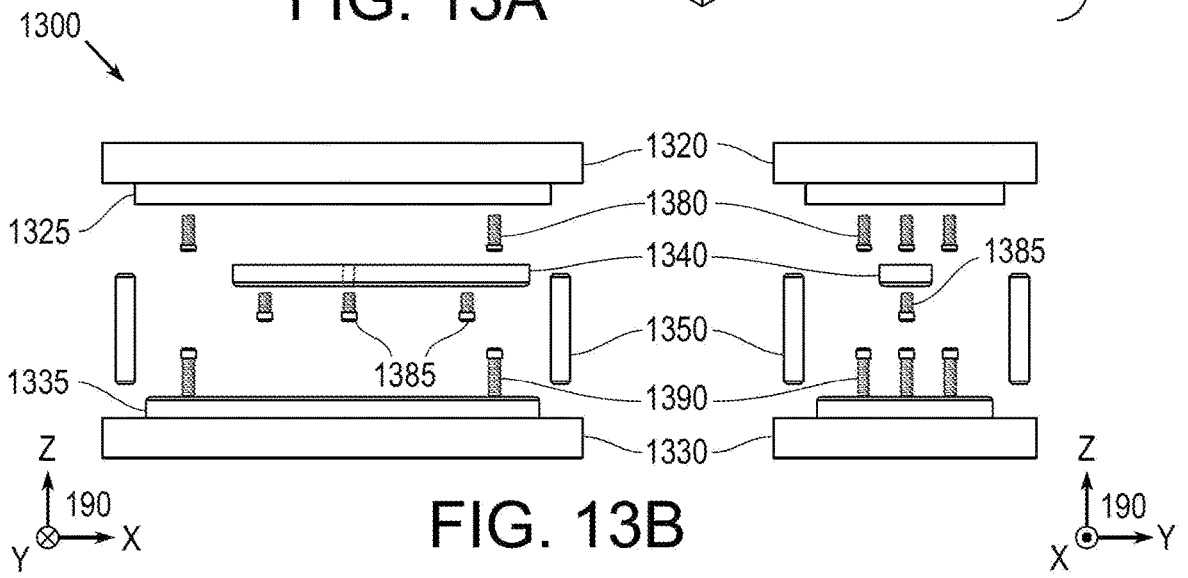

An earlier prototype for a single bottle-shape mold was developed for proof-of-concept bench press stamping demonstration. FIGS. 13A and 13B respectively show isometric and elevation exploded views 1300 of single round die components 1310 for testing. An upper block 1320 with a mount 1325 fastened thereto interfaces a lower block 1330 with a single round test die 1335 fastened thereto. A bottle-shape punch 1340 that attaches to the die 1335 can insert into a corresponding depression 1345 that extends through the lower die 1335 and the block 1330.

Four corner posts 1350 pass through corner holes 1360 on upper block 1320 and corner holes 1370 on lower block 1320 for their alignment. Screws 1380 fasten the mount 1325 to the upper block 1320. Screws 1385 fasten the punch 1340 to the die 1335. Screws 1390 fasten the die 1335 to the lower block 1330. The compass rose 190 denotes orientation. The blocks 1320 and 1330, mount 1325, die 1335 and punch 1340 all comprise steel.

Figure 14A:
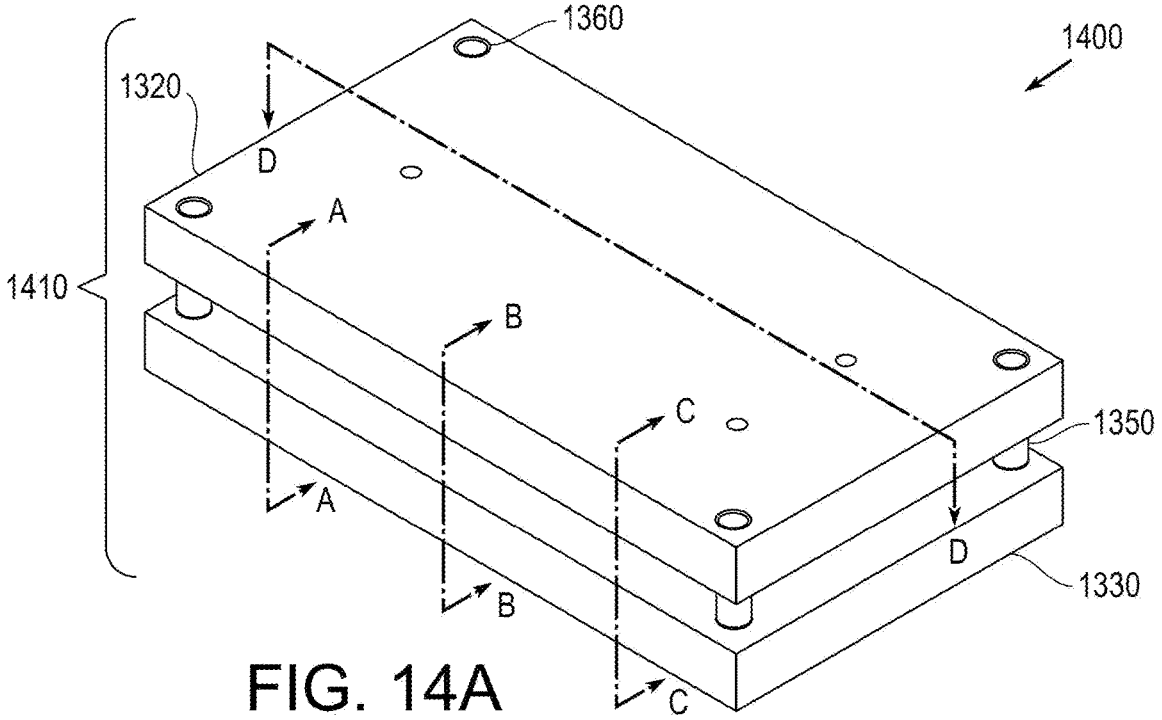
FIGS. 14A, 14B and 14C are isometric, elevation and cross-section views of a single-round test die assembly.
Figure 14B:
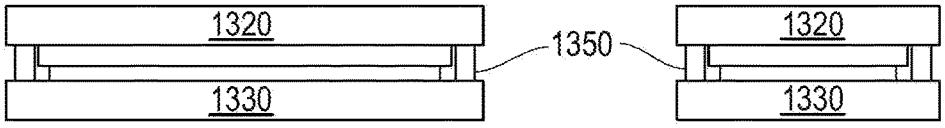
Figure 14C:
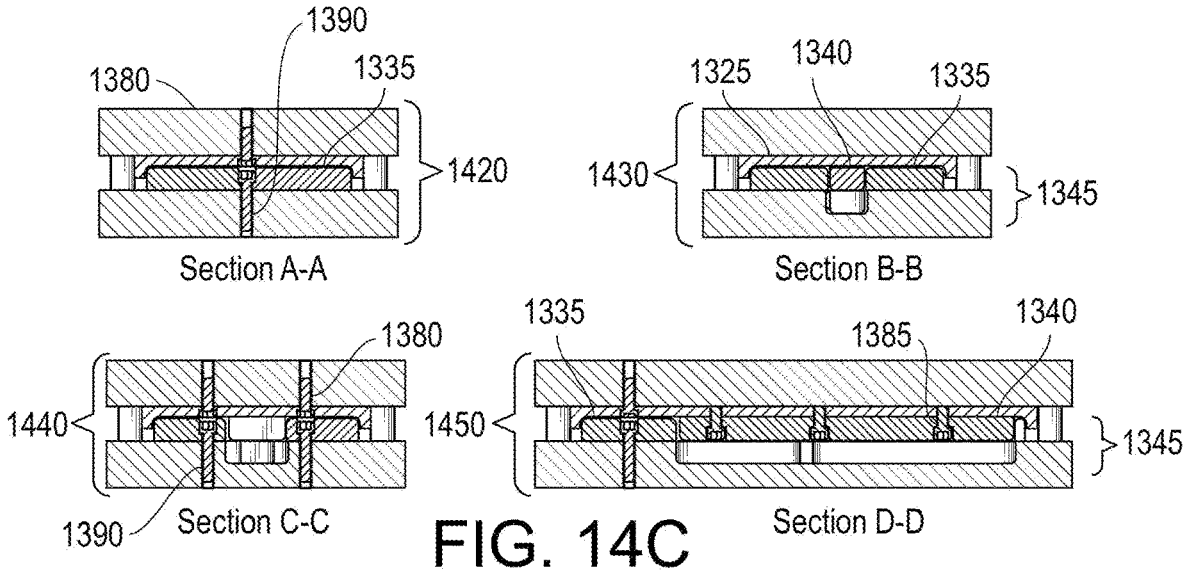

FIGS. 14A, 14B and 14C respectively show isometric, elevation and cross-sectional elevation views 1400 of a single round test die assembly 1410, developed as a prototype. FIG. 14A includes cross-section positions A-A, B-B and C-C through the lateral Y-direction distributed along the longitudinal X-direction, while position D-D runs through the longitudinal X-direction along the center. FIG. 14C presents Sections A-A 1420, B-B 1430, C-C 1440 and D-D 1450, illustrating the screws 1380, 1385 and 1390 through the blocks 1320 and 1330.

Figure 15:
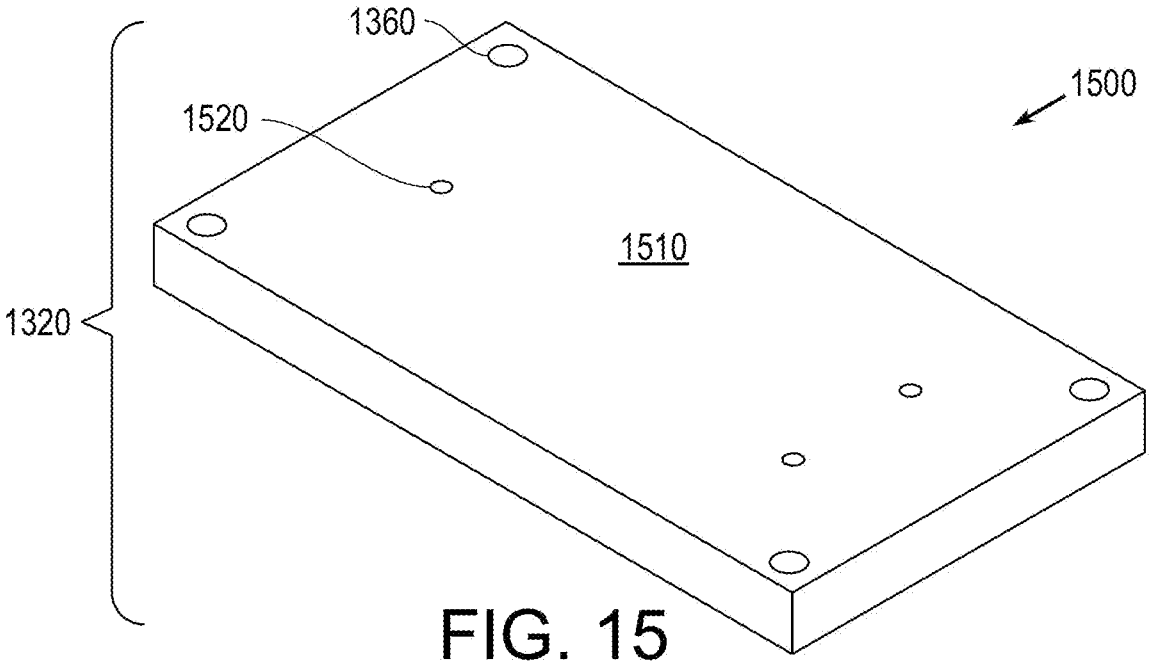
FIG. 15 is an isometric view of an upper block.

FIG. 15 illustrates an isometric view 1500 of the upper block 1320, which includes an inner face 1510 with corner holes 1360 and mount holes 1520. The block 1320 is about eleven-and-seven-eighths inches long, six-and-a-half inches wide and one inch thick. The corner holes 1360 are about one-half inch in diameter and longitudinally spaced about ten-and-a-half inches apart. The mount holes 1520 are about a quarter inch in diameter.

Figure 16:
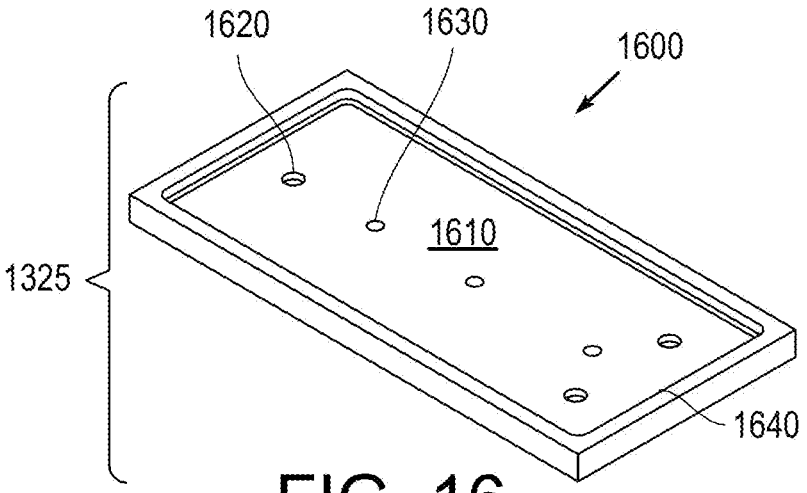
FIG. 16 is an isometric view of a mount.

FIG. 16 illustrates an isometric view 1600 of the mount 1325 with a recess face 1610 featuring block holes 1620 and punch holes 1630 within a rim 1640. The mount 1325 is about ten-and-one-third inches long, five inches wide and a half inch thick. The block holes 1620 are chamfered and have diameters of about one-quarter inch to receive screws 1380, while the punch holes 1630 have diameters of about one-quarter inch to receive screws 1385.

Figure 17:
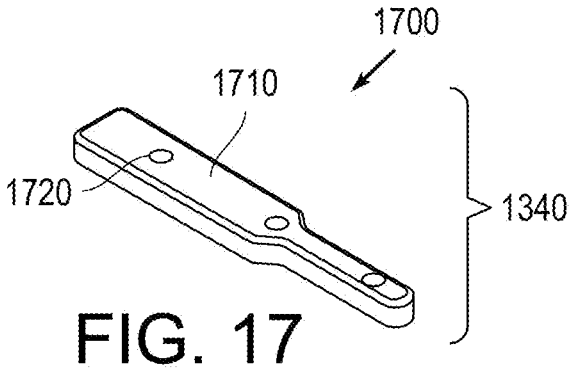
FIG. 17 is an isometric view of a punch.

FIG. 17 illustrates an isometric view 1700 of the punch 1340, including a die face 1710 and mount holes 1720. The punch 1340 is about seven-and-one-third inches long, one-and-one-quarter inches wide and a half inch thick. The mount holes 1720 align with the punch holes 1730 and are about one-quarter inch in diameter to receive screws 1385.

Figure 18:
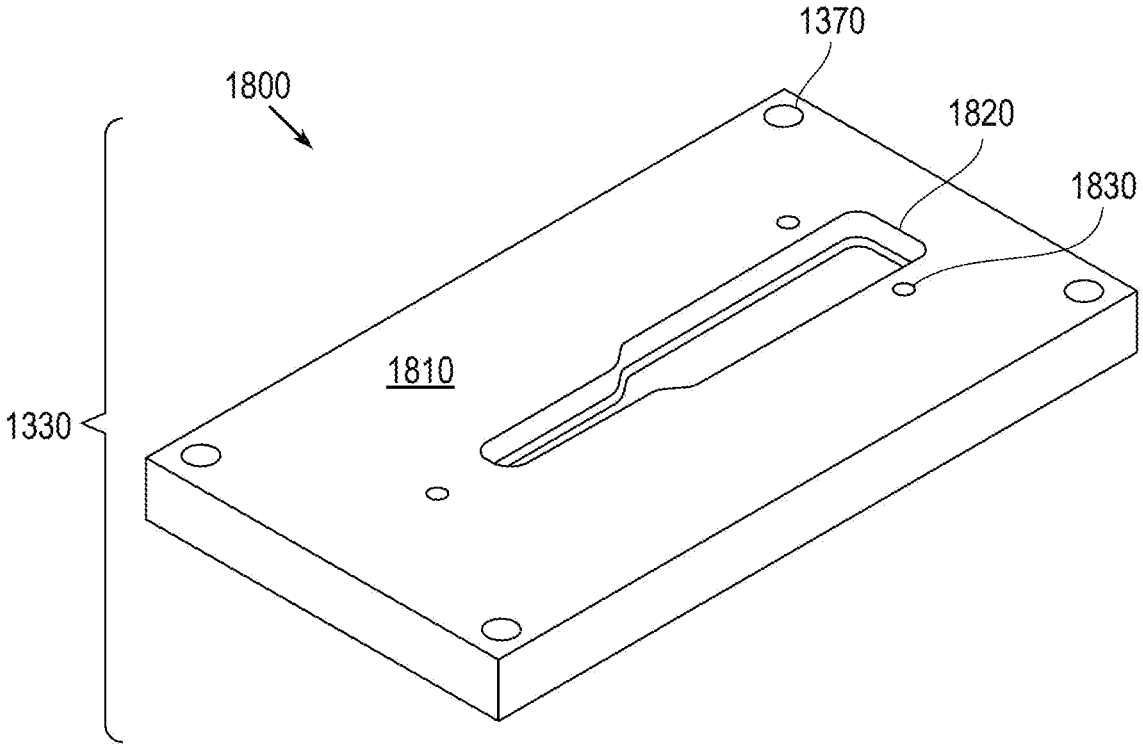
FIG. 18 is an isometric view of a lower block.

FIG. 18 illustrates an isometric view 1800 of the lower block 1330 with a die face 1810 that includes a cavity 1820 and die holes 1830. The block 1330 is about eleven-and-seven-eighths inches long, six-and-a-half inches wide and one inch thick. The corner holes 1370 are about a half inch in diameter and longitudinally spaced about ten-and-a-half inches apart. The cavity 1820 for receiving the punch 1340 is slightly more than seven-and-a-half inches long and a half inch deep. The die holes 1830 are about one-quarter inch in diameter to receive screws 1390.

Figure 19:
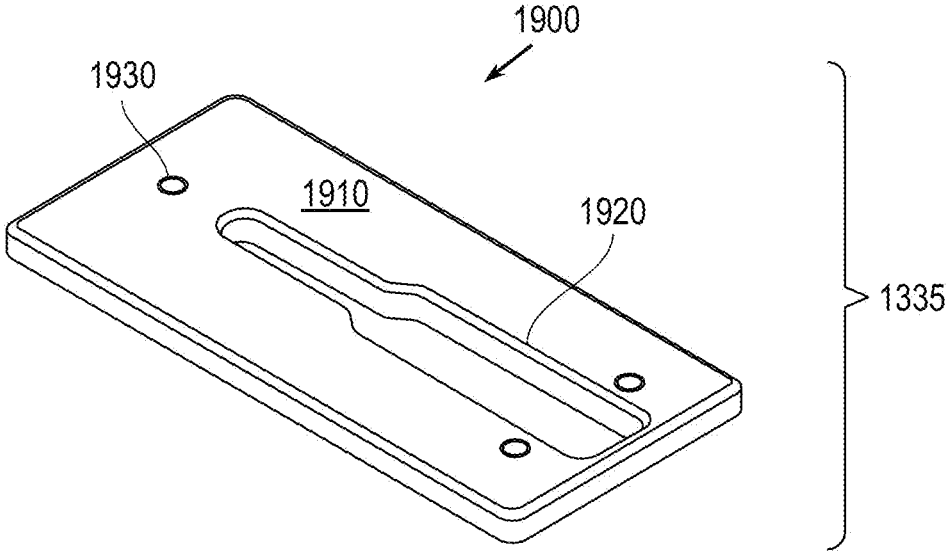
FIG. 19 is an isometric view of a single-round die.

FIG. 19 illustrates an isometric view 1900 of the die 1335 including a receiving face 1910 with a punch slot 1920 and block holes 1930. The die 1335 is about nine-and-three-quarters inches long, four-and-a-half inches wide and a half inch thick. The depression 1345 comprises the cavity 1820 and the slot 1920 to receive the punch 1340. The block holes 1930 are about one-quarter inch in diameter and align with corresponding die holes 1830 to receive the screws 1390.

The die 1335 fastens to the lower block 1330 by screws 1390. The punch 1340 attaches to the mount 1325 by screws 1385, which fastens to upper block 1320 by screws 1380. An aluminum sheet (not shown but corresponding to the face 1610) is disposed over the die 1335. Then the blocks 1320 and 1330 are aligned to each other by the posts 1350 to form the test die assembly 1410. The bench press stamps the assembly 1410 to shape the sheet into the bottle silhouette shape for containing a 25 mm round. Successful implementation of this design assembly 1410 facilitated development of the exemplary device 110.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. A stamping apparatus for producing an ammunition tray from metal sheet template with interleaving parallel cutouts in conjunction with a shop press, said apparatus comprising:

upper and lower tray dies, each die having opposite external and internal sides, said external side having a depression pocket, said internal side having a die impression to shape the template;

upper and lower binders, each said binder having a cavity, said tray dies disposed between said binders; and a pair of bolsters disposed for engaging the shop press to apply compressive force, each bolster correspondingly inserting through said cavity and into said depression pocket; wherein the template is disposed between lower and upper internal sides of respective said dies, and the shop press applies compression to said bolsters for stamping the template by said dies into the ammunition tray.

2. The apparatus according to claim 1, further comprising:

front and rear insert plates disposed adjacent to said upper binder to secure the template from lateral motion.

3. The apparatus according to claim 2, wherein said upper binder and said upper die include mutually aligned slots, and each insert plate includes a longitudinal protrusion that inserts into said-respective slot.

4. The apparatus according to claim 2, wherein said lower die and said lower binder form a lower assembly disposed on one of said bolsters on the shop press, and said upper die, said upper binder and said insert plates form an upper assembly disposed over said lower assembly with the template disposed between said lower and upper dies.

5. The apparatus according to claim 1, wherein each of said binders includes an opposing pair of longitudinal flanges, a pair of first compression resistors connect each longitudinal flange on said upper binder to a respective longitudinal flange on said lower binder, each of said binders includes six, second compression resistors disposed vertically opposite opposite said corresponding die, and said first and second compression resistors engaging the shop press to receive said compressive force together with said bolsters.

6. The apparatus according to claim 5, wherein each first compression resistor includes a first threaded stud that inserts into said of each binders, a first helical spring that surrounds said first stud, a first washer that restrains said first helical spring and a first pair of hexagonal locking nuts that restrain said first washer, and each second compression resistor includes a second threaded stud that inserts into said of each binders, a second helical spring that surrounds said second stud, a second washer that restrains said second helical spring and a second pair of hexagonal locking nuts that restrain said second washer.

7. The apparatus according to claim 1, wherein the template comprises aluminum and said dies, said binders and said bolsters comprise steel.

8. The apparatus according to claim 1, wherein said die impressions of said internal sides include parallel interleaving arc hills and valleys for shaping the template into the tray.

9. The apparatus according to claim 8, wherein the cutouts form silhouettes having longitudinally joined rectangular segments with distinguishable respective widths.

10. The apparatus according to claim 1, wherein said longitudinal flanges include handles.

11. A stamping method for producing an ammunition tray from a metal sheet on a bench press, said method comprising:

cutting parallel interleaving silhouettes into the sheet to produce a template;

inserting first compression resistors between lateral extensions of upper and lower binders having respective cavities;

inserting second compression resistors onto outer surfaces of said upper and lower binders;

disposing a first bolster onto a bed of the bench press;

disposing said lower binder to insert said first bolster into said lower cavity with said second compression resistors engaging said bed;

disposing a lower tray die onto said lower binder, said lower tray die having a lower impression corresponding to said silhouettes for shaping the template, and a lower pocket for receiving said first bolster;

disposing the template onto said lower tray die;

disposing an upper tray die onto the template, said upper tray die having an upper impression corresponding to said silhouettes for shaping the template, and an upper pocket;

disposing said upper binder onto said upper tray die;

disposing a second bolster through said upper cavity and into said upper pocket;

applying compressive force from a ram on the bench press against said second bolster, said first compression resistors and said second compression resistors; and removing said second bolster, said upper binder and said upper tray die to retrieve the ammunition tray.

12. The method according to claim 11, wherein said template is formed from aluminum sheet metal.

13. The method according to claim 11, wherein said first and second bolsters, said upper and lower binders, and said upper and lower tray dies comprise steel.

14. The method according to claim 11, further comprising:

attaching front and rear flanging inserts onto said upper binder, wherein each insert has extensions that insert into corresponding lateral slots of said upper binder and said upper tray die.

* * * * *